US011728584B2

(12) United States Patent
Huang et al.

(10) Patent No.: US 11,728,584 B2
(45) Date of Patent: Aug. 15, 2023

(54) CLAMPING TERMINAL

(71) Applicant: Tyco Electronics (Shanghai) Co. Ltd., Shanghai (CN)

(72) Inventors: Yongjian (Justin) Huang, Shanghai (CN); Tongbao (Tim) Ding, Shanghai (CN); Sheng (Andy) Li, Shanghai (CN)

(73) Assignee: Tyco Electronics (Shanghai) Co., Ltd., Shanghai (CN)

( * ) Notice: Subject to any disclaimer, the term of this patent is extended or adjusted under 35 U.S.C. 154(b) by 0 days.

(21) Appl. No.: 17/561,231

(22) Filed: Dec. 23, 2021

(65) Prior Publication Data

US 2022/0209438 A1 Jun. 30, 2022

(30) Foreign Application Priority Data

Dec. 24, 2020 (CN) ..... 202011547509.X

(51) Int. Cl.
*H01R 11/09* (2006.01)
*H01R 4/24* (2018.01)
*H01R 4/2425* (2018.01)

(52) U.S. Cl.
CPC ..... *H01R 11/09* (2013.01); *H01R 4/24* (2013.01); *H01R 4/2425* (2013.01)

(58) Field of Classification Search
CPC ..... H01R 4/24; H01R 4/245; H01R 11/09; H01R 4/2466
See application file for complete search history.

(56) References Cited

U.S. PATENT DOCUMENTS 4,834,670 A * 5/1989 Rodondi ..... H01R 4/2462 439/399
4,964,811 A * 10/1990 Hayes, Sr. ..... H01R 4/48 439/402
5,622,515 A * 4/1997 Hotea ..... H01R 43/16 439/402

FOREIGN PATENT DOCUMENTS

JP S6010307 Y2 * 4/1985

* cited by examiner

*Primary Examiner* — Briggitte R. Hammond
(74) *Attorney, Agent, or Firm* — Barley Snyder

(57) ABSTRACT

A clamping terminal comprises a first elastic arm disposed at one end thereof and includes a first elastic beam and a first upper sub-arm coupled to the first elastic beam. A second elastic arm is disposed at the other end of the clamping terminal and includes a second elastic beam and a second upper sub-arm coupled to the second elastic beam. A shared elastic arm assembly is disposed between the first elastic arm and the second elastic arm and includes at least one shared elastic beam. Two sides of the shared elastic beam are coupled to shared sub-arms respectively, such that the first elastic arm is disposed opposite to one side of the shared elastic arm assembly to form a first sub-clamping terminal. The second elastic arm is disposed opposite to the other side of the shared elastic arm assembly to form a second sub-clamping terminal.

20 Claims, 3 Drawing Sheets

CLAMPING TERMINAL

CROSS-REFERENCE TO RELATED APPLICATIONS

This application claims the benefit of Chinese Patent Application No. 202011547509.X filed on Dec. 24, 2020, the whole disclosure of which is incorporated herein by reference in its entirety.

FIELD OF THE INVENTION

The present disclosure relates to insulation displacement connectors and associated clamping wires techniques, and more particularly, to a clamping terminal utilizing the same.

BACKGROUND

Existing IDC (insulation displacement connector, i.e., piercing connector) technology can clamp a plurality of wires into different terminal slots of a clamping terminal for achieving electrical interconnection therebetween. Current IDCs join adjacent clamping terminals or terminal slots using conductive bridges or tapes. These arrangements, however, result in clamping terminals which are unnecessarily large, reducing the applications in which they may be implemented.

Improved IDCs having more efficient structures which reduce the size of the connectors are therefore desired.

SUMMARY

A clamping terminal according to an embodiment of the present disclosure comprises a first elastic arm disposed at one end thereof, and a first elastic beam and a first upper sub-arm coupled to the first elastic beam. A second elastic arm is disposed at the other end of the clamping terminal and includes a second elastic beam and a second upper sub-arm coupled to the second elastic beam. A shared elastic arm assembly is disposed between the first elastic arm and the second elastic arm and includes at least one shared elastic beam. Two sides of the shared elastic beam are coupled to shared sub-arms respectively, such that the first elastic arm is disposed opposite to one side of the shared elastic arm assembly to form a first sub-clamping terminal. The second elastic arm is disposed opposite to the other side of the shared elastic arm assembly and forms a second sub-clamping terminal.

BRIEF DESCRIPTION OF THE DRAWINGS

The invention will now be described by way of example with reference to the accompanying Figures, of which.

DETAILED DESCRIPTION OF THE EMBODIMENTS

Figure 1:
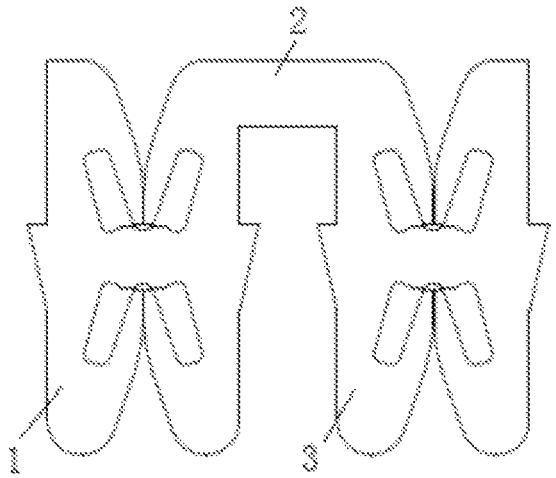
FIG. 1 (Prior Art)
FIG. 1 is a schematic diagram of a first embodiment of a clamping terminal according to the prior art.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
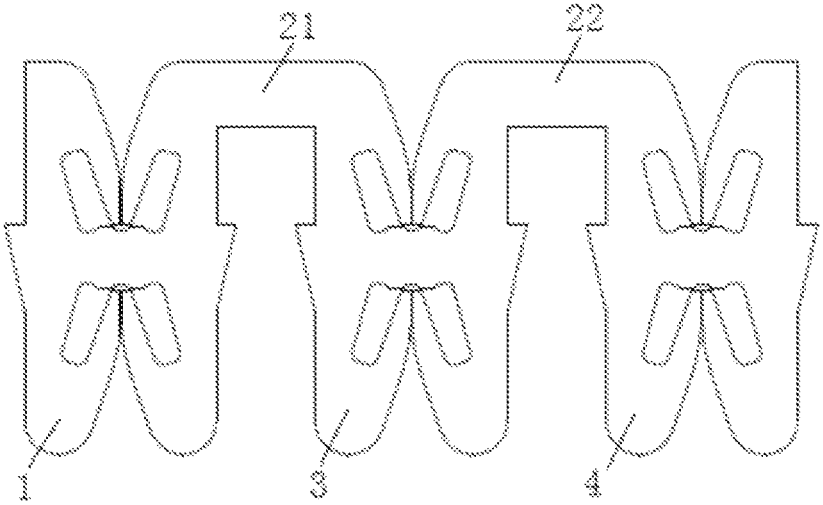
FIG. 2 (Prior Art)
FIG. 2 is a schematic diagram of a second embodiment of a clamping terminal according to the prior art.

The present disclosure provides improved IDCs for forming electrical connections between multiple wires in limited space. For example, FIG. 1 shows a clamping terminal assembly capable of achieving the interconnection of at most four wires, including a first clamping terminal 1, a bridge or tape 2, and a clamping terminal 3, wherein the clamping terminal 1 and the clamping terminal 3 are connected together via the tape 2, such that a plurality of the clamped wires can be interconnected. FIG. 2 shows a clamping terminal assembly capable of the interconnection of at most six wires, including a clamping terminal 1, a tape 21, a clamping terminal 3, a tape 22, and a clamping terminal 4, wherein the clamping terminal 1 and the clamping terminal 3 are connected together via the tape 21, the clamping terminal 3 and the clamping terminal 4 are connected together via the tape 22, so that the plurality of the clamped wires can be interconnected. As can be seen from FIGS. 1 and 2, the overall size of the clamping terminal assembly connected using the tape is large, thus the use of this type of the clamping terminal assembly puts a higher demand on installation space, reducing the use flexibility of the clamping terminal.

To solve the above problem, a clamping terminal according to the present disclosure comprises a first elastic arm, a second elastic arm, and a shared elastic arm assembly. The first elastic arm is disposed at one end of the clamping terminal, and the second elastic arm is disposed at the other end of the clamping terminal, and the shared elastic arm assembly is disposed between the first elastic arm and the second elastic arm, including at least one shared elastic beam, two sides of the shared elastic beam are coupled to shared sub-arms respectively, such that the first elastic arm is disposed opposite to one side of the shared elastic arm assembly to form a first sub-clamping terminal, the second elastic arm is disposed opposite to the other side of the shared elastic arm assembly to form a second sub-clamping terminal.

Figure 3:
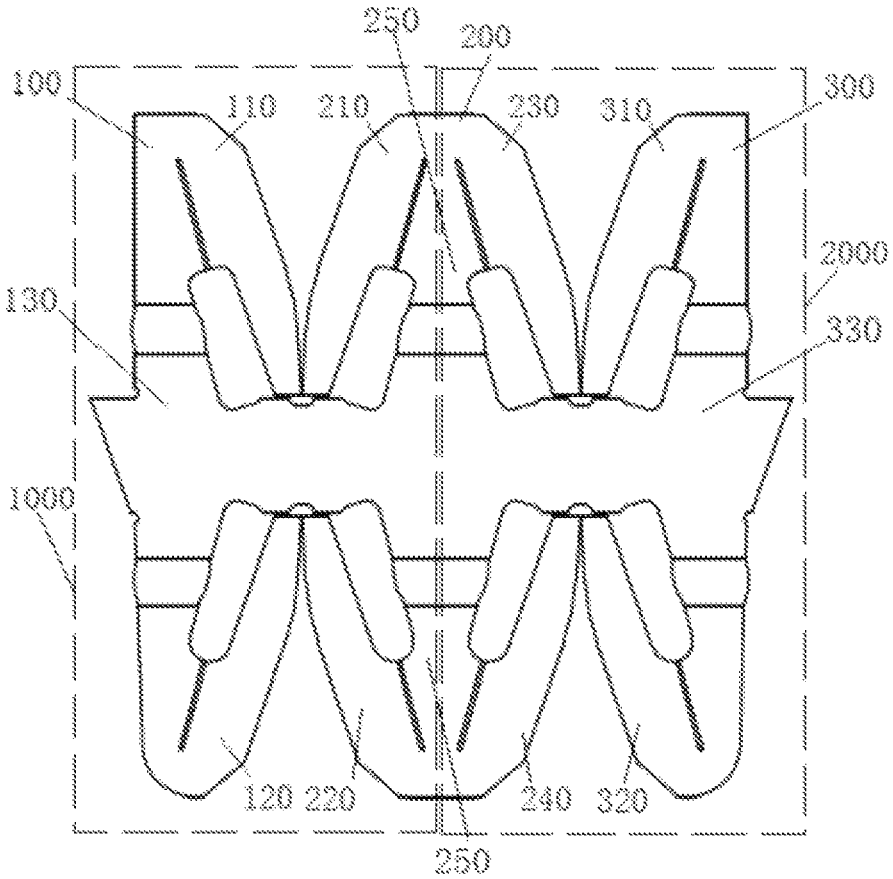
FIG. 3 is a schematic diagram of a first example clamping terminal according to the present disclosure.

The clamping terminal as shown in FIG. 3 comprises a first elastic arm 100, a second elastic arm 300, and a shared elastic arm assembly. The shared elastic arm assembly includes only one shared elastic arm 200. The shared elastic arm 200 includes a shared elastic beam 250. The first elastic arm 100 has a first upper sub-arm 110, a first elastic beam 130, and a first lower sub-arm 120 coupled with the first upper sub-arm 110 via the first elastic beam 130, the second upper sub-arm 300 has a second upper sub-arm 310, a second elastic beam 330, and a second lower sub-arm 320 coupled with the second upper sub-arm 310 via the second elastic beam 330. As shown in FIG. 3, one side of the shared elastic arm 200 includes a first upper shared sub-arm 210 and a first lower shared sub-arm 220, and the other side of the shared elastic arm 200 includes a second upper shared sub-arm 230 and the second lower shared sub-arm 240. In the exemplary embodiment, the first upper shared sub-arm 210 is coupled with the second upper shared sub-arm 230 via the shared elastic beam 250, and the first lower shared sub-arm 220 is coupled with the second lower shared sub-arm 240 via the shared elastic beam 250.

The first elastic arm 100 and one side of the shared elastic arm 200 form a first sub-clamping terminal 1000. Specifically, the shape of the first upper sub-arm 110 corresponds to the shape of the first upper shared sub-arm 210 and the shape of the first lower sub-arm 120 corresponds to the shape of the first lower shared sub-arm 220. In this way, the first sub-clamping terminal 1000 can clamp a first wire via the first upper sub-arm 110 and the first upper shared sub-arm 210, and clamp a second wire via the first lower sub-arm 120 and the first lower shared sub-arm 220.

Further, in the exemplary embodiment, the second elastic arm 300 and the other side of the shared elastic arm 200 form a second sub-clamping terminal 2000. Specifically, the shape of the second upper sub-arm 310 corresponds to the shape of the second upper shared sub-arm 230, and the shape of the second lower sub-arm 320 corresponds to the shape of the second lower shared sub-arm 240. Accordingly, the second sub-clamping terminal 2000 can clamp a third wire via the second upper sub-arm 310 and the second upper shared sub-arm 230, and clamp a fourth wire via the second lower sub-arm 320 and the second lower shared sub-arm 240. In this way, the clamping terminal disclosed herein can simultaneously clamp four wires.

The length of any sub-arm of the clamping terminal disclosed in the present embodiment (e.g., any of the first upper sub-arm 110, the first lower sub-arm 120, the second upper sub-arm 310, the second lower sub-arm 320, the first upper shared sub-arm 210, the first lower shared sub-arm 220, the second upper shared sub-arm 230, and the second lower shared sub-arm 240) is determined based on the maximum-cross section diameter of the wire to be clamped. In general, the smaller the maximum cross-sectional diameter of the wire to be clamped, the longer the corresponding sub-arm.

Specifically, according to the difference of the wires to be clamped, the corresponding sub-arm lengths are different. For example, in the exemplary embodiment, when the upper portion of the first sub-clamping terminal needs to clamp a diode wire, and the lower portion thereof needs to clamp a lacquered wire, the first upper sub-arm 110, the second upper sub-arm 310, the first upper shared sub-arm 210, and the second upper shared sub-arm 230 have corresponding shapes and same sizes, the first lower sub-arm 120 and the first lower shared sub-arm 220 have corresponding shapes and same sizes, the second lower sub-arm 320 and the second lower shared sub-arm 240 have corresponding shapes and same sizes.

It can be seen from the actual measurement that in the case where the number and types of wires to be clamped are same, the clamping terminal disclosed in the present embodiment can save at least 26% of the space in the force direction compared with the prior art. That is, the disclosed clamping terminals can effectively reduce the installation space to achieve flexible use of a clamping terminal clamping a plurality of wires in a limited space.

Further, in the case where the positive force of each sub-arm of the shared elastic arm remains unchanged, the size of the shared elastic arm can be reduced in the force direction, thereby further reducing the requirement of the installation space. Moreover, the first elastic arm may include only a first elastic beam and a sub-arm coupled with the first elastic beam, and the second elastic arm may include only a second elastic beam and a sub-arm coupled with the second elastic beam. Accordingly, the shared elastic arm of the shared elastic arm assembly includes a shared elastic beam and two sub-arms coupled with both sides of the shared elastic beam. Thus, it is understood that the formed clamping terminal can achieve to clamp a plurality of wires only in the same clamping direction.

Figure 4:
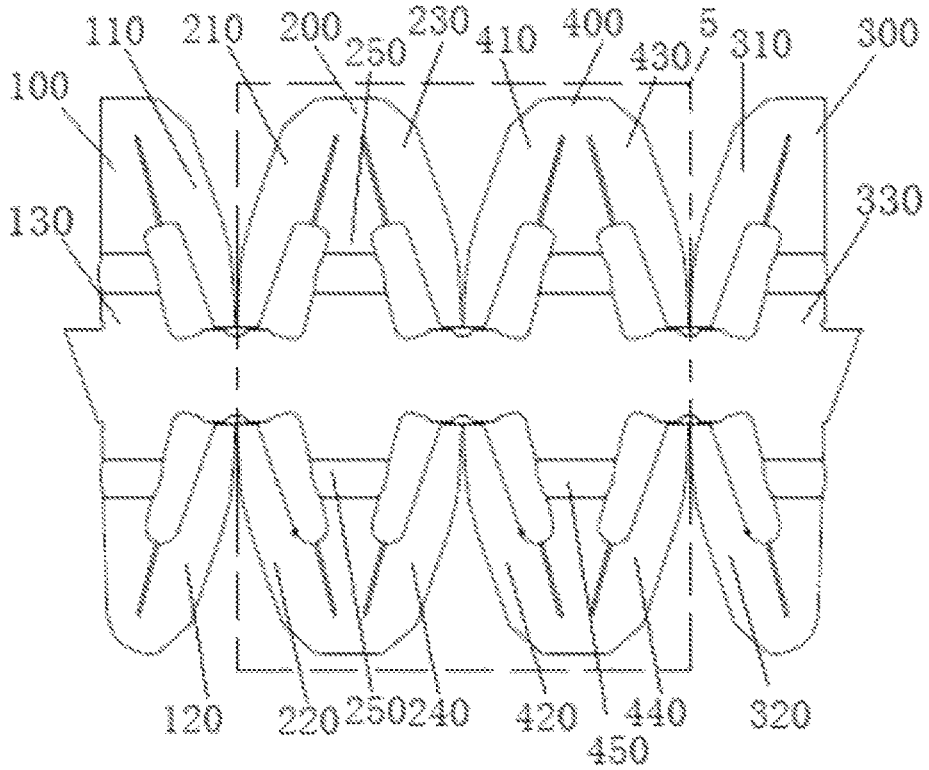
FIG. 4 is a schematic diagram of a second example clamping terminal according to the present disclosure.

A clamping terminal as shown in FIG. 4 comprises a first elastic arm 100, a second elastic arm 300, and a shared elastic arm assembly 5. In the exemplary embodiment, the shared elastic arm assembly includes a first shared elastic arm 200 and a second shared elastic arm 400. As shown in FIG. 4, the first elastic arm 100 has a first upper sub-arm 110, a first elastic beam 130, and a first lower sub-arm 120 coupled with the first upper sub-arm 110 via the first elastic beam 130. The second elastic arm 300 has a second upper sub-arm 310, a second elastic beam 330, and a second lower sub-arm 320 coupled with the second upper sub-arm 310 via the second elastic beam 330. The first shared elastic arm 200 includes a shared elastic beam 250, a first upper shared sub-arm 210 and the first lower portion shared sub-arm 220 on one side of the shared elastic beam 250, and a second upper shared sub-arm 230 and the second lower shared sub-arm 240 on the other side of the shared elastic beam 250. In this way, the first upper shared sub-arm 210 is coupled with the second upper shared sub-arm 230 via the shared elastic beam 250, and the first lower shared sub-arm 220 is coupled with the second lower shared sub-arm 240 via the shared elastic beam 250. The second shared elastic arm 400 includes a shared elastic beam 450, a first upper shared sub-arm 410 and a first lower shared sub-arm 420 on one side of the shared elastic beam 450, and a second upper shared sub-arm 430 and a second lower shared sub-arm 440 on the other side of the shared elastic beam 450. As a result, the first upper shared sub-arm 410 is coupled with the second upper shared sub-arm 430 via the shared elastic beam 450, and the first lower shared sub-arm 420 is coupled to the second lower shared sub-arm 440 via the shared elastic beam 450.

In the illustrated embodiment, the first elastic arm 100 and one side of the first shared elastic arm 200 form a first sub-clamping terminal. Specifically, the shape of the first upper sub-arm 110 corresponds to the shape of the first upper shared sub-arm 210 of the first shared elastic arm 200, and the shape of the first lower sub-arm 120 corresponds to the shape of the first lower shared sub-arm 220 of the first shared elastic arm 200. The first sub-clamping terminal can clamp a first wire via the first upper sub-arm 110 and the first upper shared sub-arm 210, and clamp a second wire via the first lower sub-arm 120 and the first lower shared sub-arm 220.

At the same time, the other side of the first shared elastic arm 200 and one side of the second shared elastic arm 400 form a sub-clamping terminal. Specifically, the shape of the second upper shared sub-arm 230 of the first shared elastic arm 200 corresponds to the shape of the first upper shared sub-arm 410 of the second shared elastic arm 400, and the shape of the second lower shared sub-arm 240 of the first shared elastic arm 200 corresponds to the shape of the first lower shared sub-arm 420 of the second shared elastic arm 400. The sub-clamping terminal can clamp a fifth wire via the second upper shared sub-arm 230 and the first upper shared sub-arm 410, and clamp a sixth wire via the second lower shared sub-arm 240 and the first lower shared sub-arm 420.

Further, the second elastic arm 300 and the other side of the second shared elastic arm 400 form a second sub-clamping terminal. Specifically, the shape of the second upper sub-arm 310 corresponds to the shape of the second upper shared sub-arm 430 of the second shared elastic arm 400, and the shape of the second lower sub-arm 320 corresponds to the shape of the second lower shared sub-arm 440 of the second shared elastic arm 400, such that the second sub-clamping terminal can clamp a third wire via the second upper sub-arm 310 and the second upper shared sub-arm 430, and clamp a fourth wire via the second lower sub-arm 320 and the second lower shared sub-arm 440. In this way, the clamping terminal disclosed in the present embodiment can simultaneously clamp six wires.

Further, the length of any sub-arm of the clamping terminal disclosed herein (e.g., any of the first upper sub-arm 110, the first lower sub-arm 120, the second upper sub-arm 310, the second lower sub-arm 320, the first upper shared sub-arm 210 of the first shared elastic arm 200, the first lower shared sub-arm 220, the second upper shared sub-arm 230, the second lower shared sub-arm 240, the first upper shared arm 410 of the second shared elastic arm 400, the first lower shared sub-arm 420, the second upper shared sub-arm 430, and the second lower shared sub-arm 440) is determined based on the maximum-cross section diameter of the wire to be clamped. In general, the smaller the maximum cross-sectional diameter of the wire to be clamped, the longer the corresponding sub-arm.

Specifically, according to the difference of the wires to be clamped, the corresponding sub-arm lengths are different. For example, when the upper portion and the lower portion of the first sub-clamping terminal clamp different wires, the first upper sub-arm 110 and the first lower sub-arm 120 has different shapes and different sizes, correspondingly, the first upper shared sub-arm 210 and the second upper shared sub-arm 230 have different shapes and different sizes.

Further, for example, when the upper portion of the sub-clamping terminal formed by the first shared elastic arm and the second shared elastic arm is the same as the upper portion of the first sub-clamping terminal, the first upper sub-arm 110, the first upper shared sub-arm 210 of the first shared elastic arm 200, the second upper shared sub-arm 230, and the first upper shared sub-arm 410 of the second shared elastic arm 400 have corresponding shapes and same sizes.

It can be seen from the actual measurement that in the case where the number and types of wires to be clamped are same, the clamping terminal disclosed in this embodiment can save at least 33% of the space in the force direction than the existing clamping terminals. That is, the disclosed clamping terminals can effectively reduce the installation space to achieve flexible use of a clamping terminal clamping a plurality of wires in a limited space. In the case where the forward force of each sub-arm of the shared elastic arm remains unchanged, the size of the shared elastic arm can be reduced in the force direction, thereby further reducing the requirement of the installation space.

Figure 5:
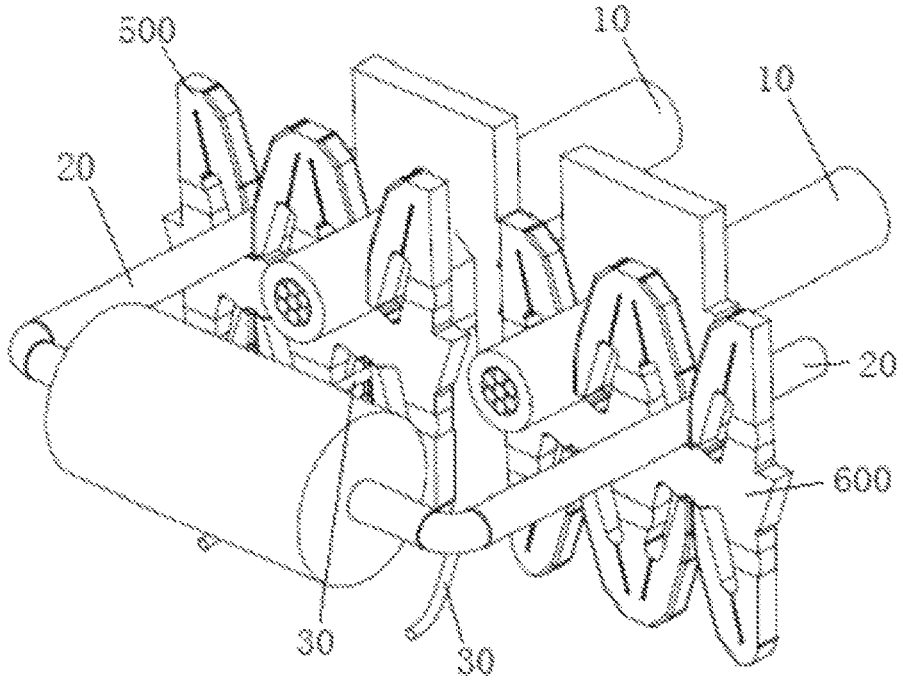
FIG. 5 illustrates a schematic diagram of an embodiment of a clamping terminal implemented according to the present disclosure.

As shown in FIG. 5, an example of two clamping terminals which are simultaneously used is disclosed. In this example, the shared elastic arm assembly of each clamping terminal includes only one shared elastic arm, such that the clamping terminal can clamp at most four wires. Further, the specific structure of each clamping terminal is similar to example 1, and is not further described here.

The two clamping terminals are arranged in parallel at an interval, so that the upper portion of the first sub-clamping terminal of the first clamping terminal 500 can clamp a diode wire 20, the upper portion of the second sub-clamping terminal of the first clamp terminal 500 can clamp a lead wire 10, and the lower portion thereof can clamp a lacquered wire 30; and the upper portion of the first sub-clamping terminal of the second clamping terminal 600 can clamp a lead wire 10, and the lower portion thereof can clamp a lacquered wire 30, the upper portion of the second sub-clamping terminal of the second clamping terminal 600 can clamp a diode wire 20. Thus, the shape and the size of the first upper sub-arm of the first sub-clamping terminal of the first clamping terminal 500 and the shape and the size of the second upper sub-arm of the second sub-clamping terminal of the first clamping terminal 500 are different because the maximum cross-sectional diameters of the wires to be clamped are different. Similarly, the shape and the size of the first upper sub-arm of the first sub-clamping terminal of the second clamping terminal 600 and the shape and the size of the second upper sub-arm of the second sub-clamping terminal of the second clamping terminal 600 are different because the maximum cross-sectional diameters of the wires to be clamped are different.

The clamping terminal may provide sub-clamping terminals with different shapes, sizes for different wires depending on the actual requirement to increase the use flexibility of the clamping terminal and customer satisfaction. The clamping terminal disclosed herein can realize the electrical connection of a plurality of wires in a limited space, which can save the occupation thereof compared to the conventional clamping terminal, and can clamp different types of wires.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A clamping terminal comprising:

a first elastic arm disposed at a first end of the clamping terminal, including a first elastic beam and a first upper sub-arm coupled to the first elastic beam;

a second elastic arm disposed at a second end of the clamping terminal opposite the first end, including a second elastic beam and a second upper sub-arm coupled to the second elastic beam; and a shared elastic arm assembly disposed between the first elastic arm and the second elastic arm and including at least one shared elastic beam, two sides of the shared elastic beam are coupled to shared sub-arms respectively such that the first elastic arm is disposed opposite to a first side of the shared elastic arm assembly to form a first sub-clamping terminal, the second elastic arm is disposed opposite to a second side of the shared elastic arm assembly to form a second sub-clamping terminal.

2. The clamping terminal according to claim 1, wherein the first elastic arm further includes a first lower sub-arm coupled with the first upper sub-arm via the first elastic beam, and the second elastic arm further includes a second lower sub-arm coupled with the second upper sub-arm via the first elastic beam.

3. The clamping terminal according to claim 2, wherein:

the shared elastic arm assembly includes at least one shared elastic arm, one side of the shared elastic arm includes at least a first upper shared sub-arm, another side of the shared elastic arm includes at least a second upper shared sub-arm, the first upper shared sub-arm is coupled with the second upper shared sub-arm via the shared elastic beam; and one side of the shared elastic arm is disposed opposite to at least one of the first elastic arm, the second elastic arm, or another shared elastic arm to form the first sub-clamping terminal, the other side of the shared elastic arm is disposed opposite to at least one of another of the first elastic arm, the second elastic arm, or another shared elastic arm to form the second sub-clamping terminal.

4. The clamping terminal according to claim 3, wherein the shape of the first upper shared sub-arm corresponds to the shape of the first upper sub-arm, one side of the shared elastic arm is disposed opposite to the first elastic arm for clamping a wire with the first sub-clamping terminal via the first upper sub-arm and the first upper shared sub-arm.

5. The clamping terminal according to claim 3, wherein the shape of the second upper shared sub-arm corresponds to the shape of the second upper sub-arm, the other side of the shared elastic arm is disposed opposite to the second elastic arm for clamping a wire with the second sub-clamping terminal via the second upper sub-arm and the second upper shared sub-arm.

6. The clamping terminal according to claim 3, wherein the shape of a first upper shared arm of a first shared elastic arm corresponds to the shape of a second upper shared sub-arm of a second shared elastic arm to form a third sub-clamping terminal having one side of the first shared elastic arm disposed opposite to the other side of the second shared elastic arm for clamping a wire.

7. The clamping terminal according to claim 3, wherein one side of the shared elastic arm further includes a first lower shared sub-arm, and the other side of the shared elastic arm further includes a second lower shared sub-arm, the first lower shared sub-arm is coupled with the second lower shared sub-arm via the shared elastic beam.

8. The clamping terminal according to claim 7, wherein the shape of the first upper shared sub-arm corresponds to the shape of the first upper sub-arm, and the shape of the first lower shared sub-arm corresponds to the shape of the first lower sub-arm with one side of the shared elastic arm disposed opposite to the first elastic arm.

9. The clamping terminal according to claim 7, wherein the shape of the second upper shared sub-arm corresponds to the shape of the second upper sub-arm, the shape of the second lower shared sub-arm corresponds to the shape of the second lower sub-arm, with the other side of the shared elastic arm disposed opposite to the second elastic arm, the second sub-clamping terminal is capable of clamping a wire via the second upper sub-arm and the second upper shared sub-arm, and clamping a wire via the second lower sub-arm and the second lower shared sub-arm.

10. The clamping terminal according to claim 7, wherein the shape of a first upper shared sub-arm of a first shared elastic arm corresponds to the shape of a second upper shared sub-arm of a second shared elastic arm, and the shape of a first lower shared sub-arm of the first shared elastic arm corresponds to the shape of a second lower shared sub-arm of the second shared elastic arm.

11. The clamping terminal according to claim 4, wherein an arm length of a corresponding sub-arm is determined based on the maximum cross-sectional diameter of the wire to be clamped.

12. The clamping terminal according to claim 4, wherein the clamping terminal is a piercing terminal for punching one or more types of lacquered wire, lead wire and/or diode wire.

13. A clamping terminal, comprising:

a first elastic arm;

a second elastic arm; and a shared elastic arm assembly disposed between the first elastic arm and the second elastic arm, having:

at least one shared elastic arm including a shared elastic beam, both sides of the shared elastic beam are respectively coupled to shared sub-arms, and one side of the shared elastic arm is disposed opposite to at least one of the first elastic arm, the second elastic arm or another shared elastic arm to form a corresponding sub-clamping terminal, and another side of the shared elastic arm is disposed opposite to at least one of the first elastic arm, the second elastic arm or another shared elastic arm to form a corresponding sub-clamping terminal, one side of the shared elastic arm includes a first upper shared sub-arm and a first lower shared sub-arm, and the other side of the shared elastic arm includes a second upper shared sub-arm and a second lower shared sub-arm, the first upper shared sub-arm is coupled with the second upper shared sub-arm via the shared elastic beam, and the first lower shared sub-arm is coupled with the second lower shared sub-arm via the shared elastic beam.

14. The clamping terminal according to claim 13, wherein the first elastic arm is disposed at one end of the clamping terminal and has a first upper sub-arm, a first elastic beam, and a first lower sub-arm coupled with the first upper sub-arm via the first elastic beam, and the second elastic arm is disposed at the other end of the clamping terminal and has a second upper sub-arm, a second elastic beam, and a second lower sub-arm coupled with the second upper sub-arm via the second elastic beam.

15. The clamping terminal according to claim 14, wherein the shape of the first upper shared sub-arm corresponds to the shape of the first upper sub-arm, and the shape of the first lower shared sub-arm corresponds to the shape of the first lower sub-arm to form a first sub-clamping terminal.

16. The clamping terminal according to claim 15, wherein the shape of the second upper shared sub-arm corresponds to the shape of the second upper sub-arm, and the shape of the second lower shared sub-arm corresponds to the shape of the second lower sub-arm to form a second sub-clamping terminal.

17. The clamping terminal according to claim 16, wherein the shape of a first upper shared sub-arm of a first shared elastic arm corresponds to the shape of a second upper shared sub-arm of a second shared elastic arm, and the shape of a first lower shared sub-arm of the first shared elastic arm corresponds to the shape of a second lower shared sub-arm of the second shared elastic arm to form a third sub-clamping terminal.

18. The clamping terminal according to claim 15, wherein the arm length of the respective sub-arm is determined based on the maximum cross-sectional diameter of the wire to be clamped.

19. The clamping terminal according to claim 15, wherein the clamping terminal is a piercing terminal for punching one or more types of lacquered wire, lead wire, and/or diode wires.

20. A clamping terminal comprising:

a first elastic arm including a first elastic beam and a first upper sub-arm coupled to the first elastic beam;

a second elastic arm including a second elastic beam and a second upper sub-arm coupled to the second elastic beam; and a shared elastic arm assembly disposed between the first elastic arm and the second elastic arm and including at least one shared elastic beam, two sides of the shared elastic beam are coupled to shared sub-arms respectively such that the first elastic arm and the second elastic arm are disposed opposite to the shared elastic arm assembly to form a respective one of a first sub-clamping terminal and a second sub-clamping terminal.

* * * * *